United States Patent [19]

Bristow et al.

[11] 4,426,196

[45] Jan. 17, 1984

[54] OIL SUPPLY SYSTEM

[75] Inventors: Ian T. Bristow, Higham; Peter A. E. Wilson, Snodland, both of England

[73] Assignee: Hobourn-Eaton Limited, Rochester, England

[21] Appl. No.: 302,520

[22] Filed: Sep. 16, 1981

[51] Int. Cl.[3] ..... F04B 49/08; F04B 49/10

[52] U.S. Cl. ..... 417/282; 417/292; 236/92 C

[58] Field of Search ..... 417/282, 292, 302, 304; 236/92 C

[56] References Cited

U.S. PATENT DOCUMENTS

| | | | |
|---|---|---|---|
| 2,446,730 | 8/1948 | Wemp | 417/282 |
| 2,747,802 | 5/1956 | Kmiecik | 236/92 C |
| 3,180,266 | 4/1965 | Smith | 417/282 |

FOREIGN PATENT DOCUMENTS

| | | | |
|---|---|---|---|
| 55-96388 | 7/1980 | Japan | 417/292 |

*Primary Examiner*—Richard E. Gluck

*Attorney, Agent, or Firm*—Wenderoth, Lind & Ponack

[57] ABSTRACT

A pumped oil supply system, for example for lubricating an internal combustion engine incorporates a relief valve the control element of which has superimposed thereon an opening force derived from a temperature responsive element responsive to the temperature of the oil delivered by the pump part of the system. The pump part has separate first and second outlets, the second outlet communicating with the oil gallery of the engine and the first outlet communicating with the second outlet through a variable restrictor. The first outlet has a relief valve with a spring-loaded piston acted on by the delivery pressure in the first outlet, and the piston is connected to a center body constituting the adjustable member of the variable restrictor. The temperature responsive element is disposed in the second outlet and imposes a resilient force on the piston which, with increase of the oil temperature, augments the action thereon of the delivery pressure in the first outlet. Oil passing through the relief valve flows to the inlet side of the pump part.

6 Claims, 4 Drawing Figures

OIL SUPPLY SYSTEM

The invention relates to an oil supply system and has a particularly useful but not exclusive application in lubricating systems of petrol and diesel engines.

Under normal operating conditions an internal combustion engine runs at different speeds and different temperatures. The lubrication requirements of the engine change with speed and the characteristics of the oil change with temperature. Therefore, the pressure and flow rate characteristics required of the oil pump vary over the operating range. Naturally, it is necessary to arrange that the oil pump is capable of delivering the maximum required flow rate at the appropriate engine speed and it should also have the ability to deliver oil at the maximum required pressure. Accordingly, a pump is provided which has more than adequate capacity for all practical conditions. Generally, a pressure relief valve is provided at the pump outlet to limit the output pressure to a pre-set maximum. Nevertheless, under most operating conditions the excess capacity of the oil pump means that power is wasted in driving the pump.

According to this invention there is provided an oil supply system comprising pumping means having an inlet and separate first and second outlets which lead to a point of utilisation whence the oil is returned to a reservoir, the inlet communicating with the reservoir, and a spring-loaded relief valve which opens progressively with increase of a delivery pressure of the pumping means above a predetermined value to by-pass a proportion of the delivery of the pumping means to the inlet side of the pumping means, a temperature responsive element responsive to a temperature of the oil delivered by the pumping means and connected to superimpose a loading on the relief valve in a sense to increase the opening of the relief valve with increase of said temperature, and a variable restrictor controlled in accordance with the control of the relief valve which restrictor interconnects said outlets.

The said first and second outlets may be provided in a single pump or in separate pumps, e.g. gear-type pumps or other positive displacement pumps.

Said relief valve may comprise a piston member slidably mounted to uncover the valve aperture to a variable extent, said piston member having the delivery pressure of the first pump applied to it to urge it in a sense to open the valve against the force of a spring urging the piston in the opposite direction.

The piston member may be connected to the control element of the variable restrictor. This control element may comprise a centre body slidably mounted within an annular passage such that axial movement of the centre body alters the effective area of the restrictor.

The temperature responsive element may comprise a bi-metal strip, which is intrinsically resilient. Alternatively, however, the temperature responsive element may comprise a wax type thermostat which has an output member whose movement depends upon the degree of expansion of a wax sleeve. With such an arrangement a spring is preferably used to couple the output member to the relief valve piston.

The invention will further be described with reference to the accompanying drawings, in which.

Figure 1:
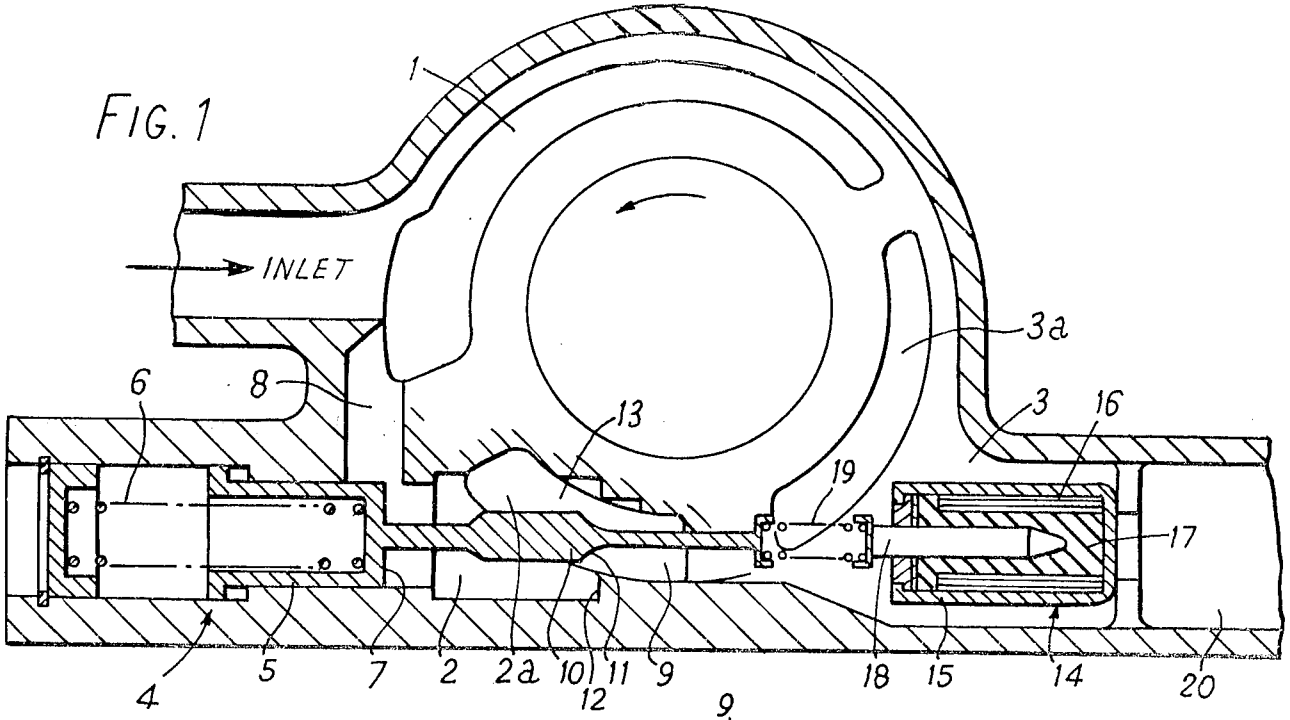
FIG. 1 is a cross-sectional view of an oil supply system embodying the invention.
Figure 3:
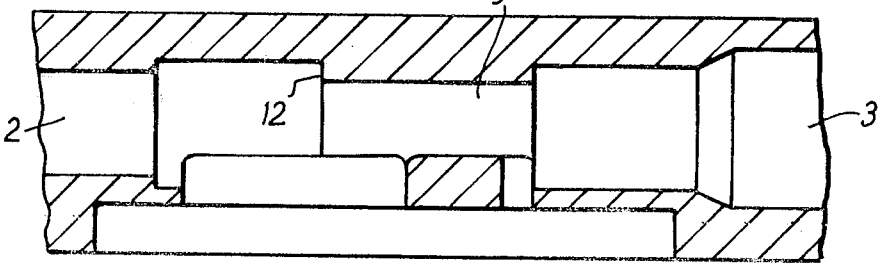
FIG. 3 is a cross-sectional elevation of the coupling passage of the system of FIG. 1.
Figure 2:
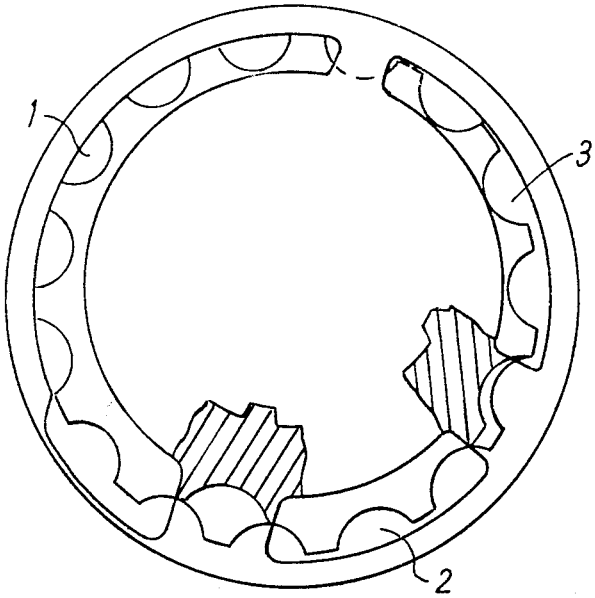
FIG. 2 is a plan view illustrating the porting of the pump of FIG. 1.

Referring to FIGS. 1 to 3 the pump system comprises a double pump constituted by a rotor pump arrangement with two sets of ports. The rotor pump is of the kind described, for example in British Patent Specification No. 596379. It comprises a lobed rotor which rotates about a fixed axis disposed eccentrically within a lobed outer rotor, the two rotors making permanent rubbing contact at points spaced around their periphery and defining a gap which decreases in volume between fixed inlet and outlet ports. In the arrangement of FIG. 1 there are effectively two pumps having a common inlet port 1. The first pump has an outlet port 2a which is coupled to a chamber 2 and the second pump has an outlet port 3a which communicates with a chamber 3. A main outlet duct 20 leads to the appropriate point of utilisation.

A relief valve 4 is provided comprising a piston 5 spring-loaded by a spring 6 towards a position in which the piston obstructs a by-pass channel 8 through which oil from chamber 2 can be returned to the inlet 1. The face 7 of the piston is subjected to the pressure of the oil in chamber 2 and when this pressure exceeds a predetermined level the piston is depressed sufficiently to open by-pass channel 8 to a degree dependent upon the said pressure.

A passage 9 interconnects chambers 2 and 3 and a restrictor core 10 disposed in the passage is shaped to have a shoulder 11. A step 12 in the wall of the passage defines with shoulder 11 an annular restriction 13, the effective area of which depends upon the axial position of the core. The core 10 is fixed to piston 5.

Chamber 3 houses a temperature-sensitive element 14 which comprises a rigid casing 15, a wax sleeve 16, a rubber insert 17 within the sleeve and an actuating member 18 bonded in the insert 17. At high temperatures the wax softens and expands and tends to expel the member 18. Member 18 is axially coupled to the stem of core 10 through a compression spring 19. The effect of the temperature-sensitive element 14 is to apply to piston 5, through spring 19, an axial force which augments the force exerted by the oil pressure and which increases with temperature. Thus, at high temperatures the pressure setting of the relief valve 4 is reduced.

Figure 4:
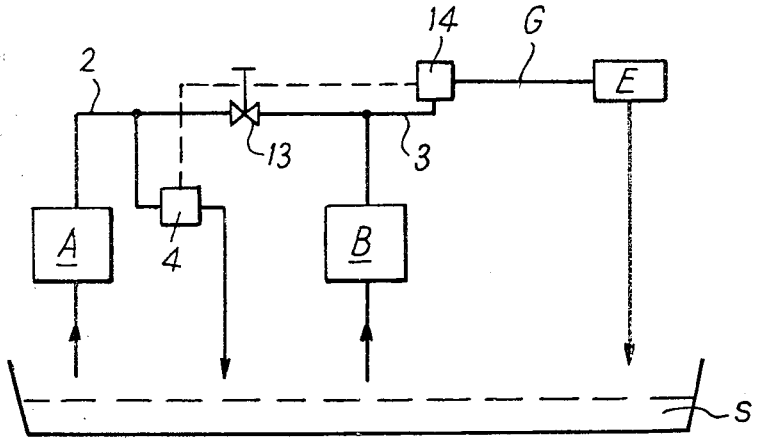
FIG. 4 is a schematic block diagram of the system of FIG. 1.

FIG. 4 shows the arrangement of FIGS. 1 to 3 in schematic form. The first pump is designated A and the second pump B. The pumps draw oil from the sump S and feed the oil supply gallery G which supplies oil to the moving parts of the engine E, from whence the oil is returned to the sump. The pressure relief valve 4 by-passes pump A, depending on the pressure in chamber 2. The pressure setting of valve 4 is determined by the temperature sensitive element 14.

Movement of the piston 5 of valve 4 actuates movement of the restrictor core 10 (FIG. 1) and thus controls the restriction 13 in the passage 9 coupling the outlets 2 and 3 of the pumps A and B.

The operation of the system can be described with reference to four basic conditions:

(a) high temperature and low speed—requiring relatively low oil pressure;

(b) high temperature and high speed—requiring higher oil pressure than (a) to give adequate flow;

(c) low temperature and low speed—requiring higher oil pressure from the pump than (b) to overcome the high pressure drop in the gallery; and (d) low temperature and high speed—also requiring higher oil pressure at the pump than (b).

Thus, in operation, in condition (a)—high temperature and low speed—the flow from pump A is relatively small and the pressure drop across restriction 13 is small. Pump A is effectively connected to pump B and augments the flow. Thus, even though the pumps are being driven slowly because of the low engine speed, adequate pressure and flow is developed.

As engine speed increases the pressure rises until the relief valve 4 opens at the predetermined pressure. This pressure may be typically of 2 bars or so, which is significantly less than the setting of 6 bars typically employed to cater for the cold oil condition in pumps not embodying the invention. When the relief valve opens, the flow from pump A is split, part going to the engine and part being by-passed. Continuing increases in speed open the relief valve further until the valve is fully open and causes the total flow from pump A to be returned to the suction side of the pump. At this time the pressure from pump B is adequate to supply the needs of the engine and the power lost in driving pump A is kept to a minimum. As there is now no flow across restriction 13 there is no pressure differential between chambers 2 and 3.

Further rise in speed (condition (b) above) causes the pressure in chamber 3 to rise above that in chamber 2 and oil flows in the reverse direction through the restriction 13 and is returned to sump S via the relief valve 4. At maximum speed the pressure at the output of pump B is greater than the relief pressure because of the effect of the flow through restriction 13. Restriction 13 is made variable by the contour of shoulder 11 to optimise the flow characteristics.

For condition (c), when the oil is cold and the speed is low, pump B is able to deliver all the required oil because even at low speed it develops sufficient pressure by virtue of the fact that the oil is cold. Pump A also produces a high pressure oil flow and this opens the relief valve 4. Thus, excess flow from pump B can pass through the restriction 13 to the by-pass channel. Because of this restriction, however, the pressure in chamber 3 can rise above the low relief setting of the valve 4 and adequate pressure can be provided. Therefore, 6 bars of pressure may be raised, for example, even though the pressure setting of valve 4 is only 2 bars.

In condition (d), the flow and hence the available pressure is greater and the excess flow from pump A and any excess flow from pump B is effectively by-passed as in condition (c).

The effect of the temperature compensation of the relief valve setting by element 14 has been explained above and further helps optimisation of the pump characteristics.

We claim:

1. An oil supply system comprising pumping means having an inlet and separate first and second outlets, at least one of said outlets leading to a point of utilization of pumped oil, a reservoir to which oil is returned from the point of utilization, the said inlet communicating with said reservoir, and a spring-loaded relief valve in the other of said outlets and which opens progressively with an increase of a delivery pressure of the pumping means above a predetermined value to by-pass a proportion of the delivery of the pumping means to the inlet side of the pumping means, a temperature responsive element responsive to a temperature of the oil delivered by the pumping means through said one outlet and connected to superimpose a load on the relief valve in a sense to increase the opening of the relief valve with an increase of said temperature, and a variable restrictor controlled in accordance with the control of the relief valve which restrictor interconnects said outlets.

2. An oil supply system as claimed in claim 1 wherein the relief valve comprises a valve aperture and a piston member slidably mounted to uncover the valve aperture to a variable extent, said piston member having applied thereto the delivery pressure at the other pump outlet to urge the member in a sense to open the valve against the force of a spring urging the piston member in the opposite direction.

3. An oil supply system as claimed in claim 1, wherein the relief valve comprises a valve aperture and a piston member slidably mounted to uncover the valve aperture to a variable extent, said piston member having applied thereto the delivery pressure at the other pump outlet to urge the member in a sense to open the valve against the force of a spring urging the piston member in the opposite direction and wherein the variable restrictor has a controlling element, the piston member being connected to said controlling element.

4. An oil supply system as claimed in claim 3, wherein the controlling element of the variable restrictor comprises a centre body slidably mounted within an annular passage such that axial movement of the centre body alters the effective area of the restrictor.

5. An oil supply system as claimed in claim 4, wherein a compression spring is connected between the centre body and the temperature responsive element.

6. An oil supply system as claimed in claim 4, wherein the temperature responsive element comprises a housing disposed in the outlet passage of the one outlet and containing a quantity of wax, and a rod slidably mounted in the housing so as to be caused to project from the housing to a greater or lesser extent with expansion or contraction of the wax with variation of temperature of the oil flowing about the housing, said rod constituting the outplut member of the element.

* * * * *